US006532396B2

(12) United States Patent
Gaukler et al.

(10) Patent No.: US 6,532,396 B2
(45) Date of Patent: Mar. 11, 2003

(54) PROCESS AND APPARATUS FOR CONTROL OF A COMPONENT OF A TEXTILE MACHINE WITH A PLURALITY OF SIMILAR, ADJACENT WORKSTATIONS

(75) Inventors: Jürgen Gaukler, Stuttgart (DE); Mario Maleck, Kipfenberg (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 48 days.

(21) Appl. No.: 09/753,994

(22) Filed: Jan. 3, 2001

(65) Prior Publication Data

US 2002/0013638 A1 Jan. 31, 2002

(51) Int. Cl.[7] ..... B65H 63/00
(52) U.S. Cl. ..... 700/143; 57/100; 112/275
(58) Field of Search ..... 700/130, 143, 700/136, 138, 139, 140, 141; 57/78, 80, 81, 82, 100; 112/102.5, 277, 275

(56) References Cited

U.S. PATENT DOCUMENTS 3,678,673 A * 7/1972 Prochazka et al. ..... 57/82 X
4,100,942 A 7/1978 Tschudi
4,379,325 A 4/1983 Krampe et al.
4,777,790 A 10/1988 Raasch
4,879,475 A 11/1989 Rüge et al.
5,113,123 A 5/1992 Noser et al.
6,349,142 B1 * 8/2002 Ebata et al. ..... 112/102.5

FOREIGN PATENT DOCUMENTS

| | | |
|---|---|---|
| DE | 3324243 | 2/1984 |
| DE | 3347113 | 7/1985 |
| DE | 3900408 | 7/1990 |
| DE | 4338283 | 5/1995 |
| EP | 0385530 A1 | 9/1990 |
| EP | 0949179 | 10/1999 |
| GB | 1085520 | 10/1967 |

* cited by examiner

*Primary Examiner*—Peter Nerbun
(74) *Attorney, Agent, or Firm*—Dority & Manning

(57) ABSTRACT

A process and apparatus are provided for controlling components of individual work stations of a textile machine wherein the textile machine includes a plurality of adjacent such work stations. The work station components are run at a first speed during normal operation. A time period is established at the start of a voltage loss to the components. At the conclusion of this time period, the components are shut down. The components assume a second set speed as they run down during the time period beginning at the start of the voltage loss. Upon the voltage loss, an auxiliary current source is activated and the speed of the components which are supplied with auxiliary voltage from the current source is reduced in a controlled manner with the aid of a control program.

19 Claims, 2 Drawing Sheets

PROCESS AND APPARATUS FOR CONTROL OF A COMPONENT OF A TEXTILE MACHINE WITH A PLURALITY OF SIMILAR, ADJACENT WORKSTATIONS

BACKGROUND OF THE INVENTION

The present invention concerns a process for the control of a component of a textile machine as well as concerning an apparatus for the execution of the process.

In the case of modern textile machines, the customary practice is to provide components for the control of the complex process at each workstation. These components themselves, are controlled with the aid of individual regulators which in turn are in communication through a bus system with an over-all control center (EP 0 385 530 A1). This known arrangement has the capability of controlling the startup of the components of a workstation as well as correcting such faults as arise. During the operation of a textile machine, long or short term power failures from various causes can occur, and the machine is deprived of the current necessary to carry on an orderly operation.

OBJECTS & SUMMARY OF THE INVENTION

It is therefore a principal object of the present invention to create a process and an apparatus of such a nature that the flow of production need not be cut off or shutdown during short term power failures. In accord with an additional purpose, it is also desirable that, following longer voltage losses or breakdowns, the workstations can be restored to operation in the shortest possible time. Additional objects and advantages of the invention will be set forth in part in the following description, or may be obvious from the description, or may be learned through practice of the invention.

The principal purpose is achieved by presetting specified speeds of rotation of a component of a textile machine workstation and presetting a time period for the deceleration of the various components. The speeds of the components during this deceleration can be maintained in a defined sequential manner, while the required relative speeds are retained at such a level that an orderly operation remains possible. By this means, the produced material, for instance, a yarn, does not deteriorate in quality.

If, before the expiration of the specified time period, the necessary voltage is restored, then the components in a controlled or regulated manner come back up to their operational speeds without the necessity of taking an operational interruption. This corrective action assures, that the relative speeds of the components among each other necessary for an orderly production always remain in effect not only during a reduction of speed, but also during a subsequent acceleration.

Advantageously, the period of time, during which the speed reduction takes place in a controlled manner, is specified to endure generally up to 3 seconds and/or is determined with dependency on the first set speed.

In order to assure, that, independent of their individual inertias, the components can accelerate properly, it is an advantage, if, within the invented formulation of the present process, the acceleration does not occur from a constant speed phase, until after a delay for constant speed conformation is established by all components. This task is accomplished by having the component, for a second specified time period, driven at essentially constant speed, before it is accelerated in a controlled or regulated manner to the first set speed.

The auxiliary current supply, which is delivered during a short-time power loss for the purpose of bridging over the no-current spell, can be produced for a short, determined time from the momentum of the still running textile machine. Thus, those components, which determine or influence the loss of the products produced on the machine during the power drop out—the products being, for instance, a fiber band or a yarn—hold the products in a desirable speed relationship to each other. The momentum, which serves as this auxiliary energy source, loses more and more energy, i.e., speed, as the power loss continues. Thus, such a current can be maintained only for a short period, and is designated for control and drive of each component, which component contributes to an essentially unchanged product. In accord with the invention, upon the expiration of a first period, during which the components in a controlled or regulated manner are slowed in rotational speed, then the components with the greatest speed are brought to a stop by running without control or they are braked. This allows the textile machine to be brought in the quickest way into a state from which it can be started up again in a controlled or regulated manner. Besides relying on the momentum, for instance, the auxiliary energy can be made available by batteries or by a lagging motor of the system or by a neighboring machine acting as yet another auxiliary energy source.

In accord with the invention, an apparatus serves for the execution of the described process. A voltage monitor continually checks the voltage of the current supplied by the utility network and signals the control system of any deviation from the specified voltage, so that the control equipment can react immediately to a loss of voltage, and the components can wind down in a controlled fashion. The two set RPM's provide the range of the speed of rotation, which must continue through the span of time set by the control input. In this way, the speed curve from component to component can vary. The manner, that is, the downward curve, of the speed reduction is determined in dependency on the chosen set rotational speeds by a program which was previously input into the control apparatus.

When the required voltage is again available, then an acceleration of the components is introduced. If the full voltage is restored before the preset shutoff time is reached, then the components are accelerated in a controlled or regulated way, so that the properties of the produced products are not changed. In order to provide a mutual accommodation phase to the components to be accelerated, and to give them sufficient time to be able to follow the acceleration independent of their inertial delay in the required manner, a time-control mechanism is advantageously constructed. The time-control mechanism insures the components are driven at a constant speed until full voltage is restored and that the components are accelerated in a controlled or regulated manner to the first speed of normal operations.

If the prescribed time interval has run out, then the speeds, such as were required for a proper production, can no longer be maintained. A reacceleration of the components now has no point, since the required speed ratio between the individual components has been destroyed, even if the required voltage had been renewed. In order to once again be able to bring the production up in an orderly manner, the invention provides that the components first are brought to a stillstand as quickly as possible, so that the combination of the components can be accelerated from the stillstand and brought up to production speed in a regulated manner.

If the components and the individual or central control apparatuses are connected together by a field bus-system, then a very rapid and simple communication between one another by means of data exchange is possible.

If one or more or the components signal to the individual or central control apparatus that certain conditions, such as, the achievement of a specified rate of rotation or a set rotational ratio to other components has been met, then a particularly uniform and rapid acceleration of the components can be achieved.

The present invention enables, in a more simplified way, the reduction of the idle time periods of the textile machines of the previously mention type. This reduction is achieved by short time failures of voltage not leading immediately to shutdown of the machine. Rather, the machine is caused to carry on with production, even at a declining speed as long as a specified time interval is not overstepped. This declined speed of production continues until the components regain their normal operational speed either by renewed application of the required voltage or the components are brought to the idle state as quickly as possible upon continued absence of voltage. In the latter circumstance, the components are prepared to be immediately set into operational performance in the usual manner when current is once again available.

Embodiments of the invention are described and explained in greater detail with the aid of drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

The process, in accord with the invention, can be applied in corresponding ways to various textile machines. This is especially true if these machines exhibit a plurality of similar workstations. This plurality of similar workstations is the case with such machines as ring-spinning machines and conventional or unconventional machines, for instance, open-end, wind-up, or spool machines. Even in the case of any one of these textile machines, the execution of the process described in the following in detail is not based on a special design of any one such machine. For example, an open-end spinning machine need not be designed as a rotor spinning machine. The invented process further allows its use with friction spinning machines, electrostatically operating spinning machines or with air spinning machines or the like.

Figure 2:
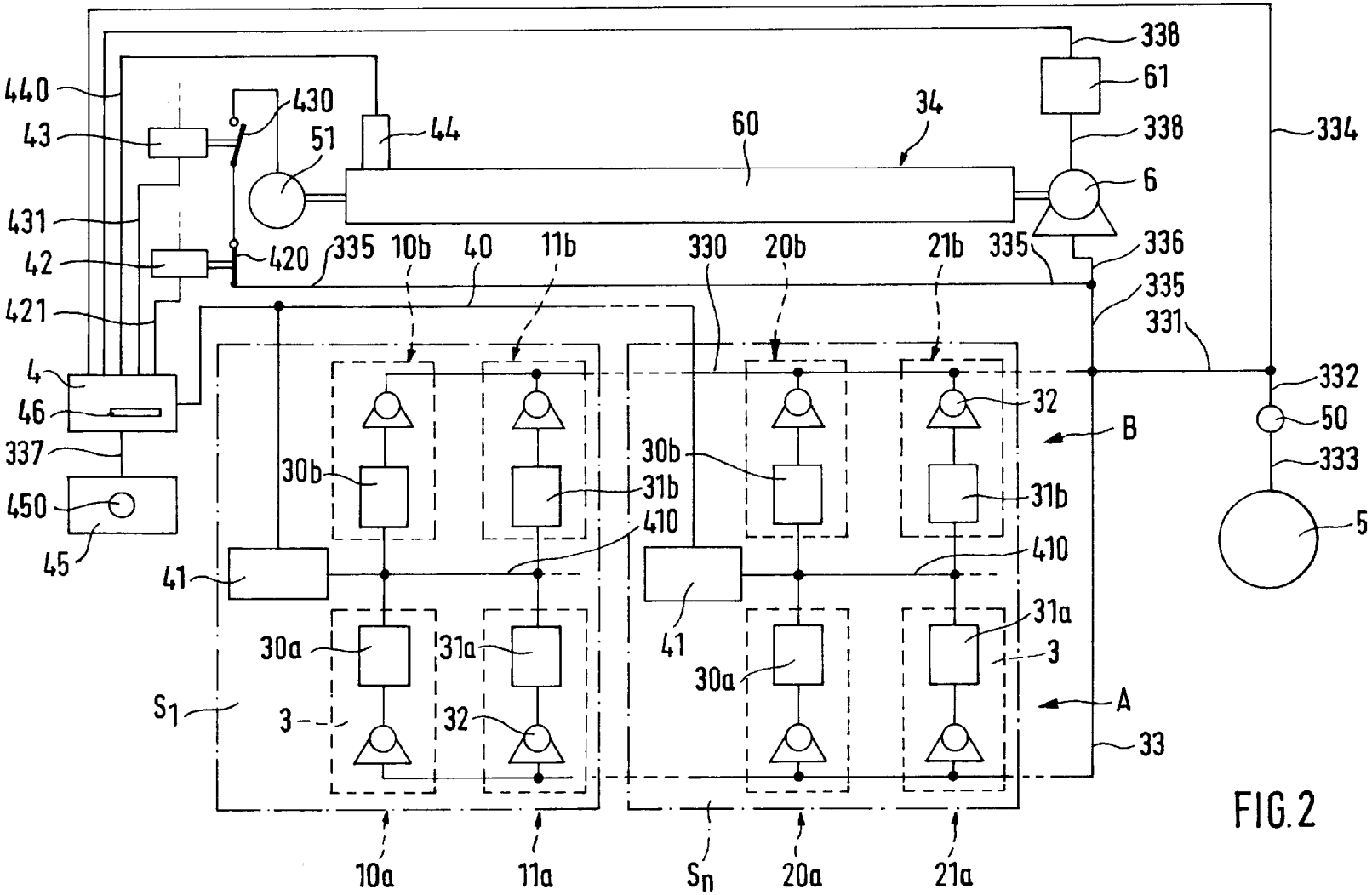
FIG. 2 shows a schematic presentation of the construction of the apparatus in accord with the invention.

Before the invented process is explained, the essential elements which carry out such a process should be described with the aid of FIG. 2.

Independent of the special designs of one of the above mentioned textile machines, these machines possess at least a multiplicity of workstations 10*a*, 11*a* . . . , 20*a*, 21*a* along a longitudinal side A. However, in some cases, as is shown in FIG. 2, on the second longitudinal side B of the machine, a further multiplicity of such workstations 10*b*, 11*b* . . . , 20*b*, 21*b* . . . , are provided.

For simplicity's sake, examples in the following, as a rule, will be essentially referred to the workstation 10*a*. The other workstations 11*a* . . . , 20*a*, 21*a* . . . , 10*b*, 11*b* . . . , 20*b*, 21*b* . . . of a generically designed textile machine are all built equally the same.

The workstation 10*a* possesses a plurality of controlled components 3 of which essentially one individual component 3 is shown, in order not to cause the presentation in FIG. 2 to be too cluttered.

In the concept of the present invention, the word "component" is to be understood as that apparatus which is controllable and thereby can influence the loss of the product in various manners. It is obvious that, in accord with the characteristics of the textile machine, these components 3 can be designed in various manners. Even in textile machines of the same kind, for instance, in an open-end machine constructed as a rotor spinning machine, these components 3 may be of different design, which design, among other things, is dependent upon the characteristics of the machine and the varied degree of its automation.

In order to clearly state what should be understood by a component 3 in the concept of the present invention, an example of an open-end spinning machine will be used for explanation in the following, even if the components 3 and the open-end spinning machine are not shown in detail. Such an open-end spinning machine possesses a feeding apparatus for the forwarding of a fiber band to a disintegrator, by means of which a fiber band is dissociated into individual fibers. These fibers then proceed to a spinner element wherein the fibers conducted thereto from the disintegrator are bound into the end of a yarn. This yarn is continually removed by means of a yarn withdrawal apparatus as the yarn is pulled from the spinner element and is conducted further to a spool apparatus for the formation of a spool. In the case of open-end spinning machines, the apparatuses to be regarded as components in the concept of the invention are namely the feed apparatus, the disintegrator, the spinning element (spinning elements), the yarn withdrawal apparatus as well as the spool apparatus.

Further auxiliary apparatuses or components such as, for instance, one of the band conducting means before the feed apparatus, a yarn delivery device and an auxiliary apparatus for the driving of the spool during the startup or beginning phase are also, as a rule, additionally provided.

Where the present invention is concerned, it is also of no concern as to whether or not the components 3 are installed in the work station 10*a* of the textile machine or whether one (or more) of these components 3 is placed on a mobile service device (not shown) which travels along the longitudinal side of the machine, or the component 3 is driven by a motor placed temporarily on a such a service device.

If, again, per workstation 10*a* . . . , a plurality of components 3 are provided, this does not mean that the invented achievement must be exercised in the case of all components in the workstation 10*a* or that all the named components 3 must be controlled in the same way and in accord with the following process which is about to be described. In accord with and in respect to the design of the workstation 10*a* . . . and its components 3, it can suffice if simply one or two components 3 of the workstation 10*a* are controlled by the here disclosed processing method.

The controlled connections are schematically presented in FIG. 2. In accord with the embodiment shown in this figure, it is indeed presupposed that the textile machine is comprised of a multiplicity of sections $S_1$ to $S_n$. However, this is not necessarily a presupposition that the invented process cannot be carried out in the case of textile machines of the named type that have no more than simply a single section $S_1$.

Now according to the embodiment shown in FIG. 2, a machine central control apparatus 4 is provided, with which is connected, through a bus system 40 per section $S_1 \ldots S_n$, to each section control apparatus 41. Each of these section control apparatuses 41 communicates through a bus system 410 with a plurality of individual control apparatuses, 30*a*, 31*a* . . . , 30*b*, 31*b* . . . In this way, the individual control apparatuses 30*a*, 31*a* . . . on the longitudinal side A and the control apparatuses 30*b*, 31*b* . . . on the other side B of the machine are respectively placed beside one another.

Each of the depicted components 3 possesses a drive 32, besides the individual control apparatuses 30*a*, 31*a* . . . , and/or, 30*b*, 31*b* . . . The drive 32 of the various workstations 10*a*, 11*a* . . . , 20*a*, 21*a* . . . and 10*b*, 11*b* . . . and 20*b*, 21*b* . . . are connected by a line 33 and/or 330 as well as other lines 331, 332, 333 with a main source 5. The main source is, as a rule, the utility network. Between the line 332 and 333 is found a voltage monitor 50, which, by means of a line 334, is in communication with the central control apparatus 4. Voltage monitor 50 continually watches over the voltage of the main source 5.

The central control apparatus 4 possesses an input apparatus 46, the purpose of which will be explained later. Furthermore, the central control apparatus 4 (in accord with FIG. 2 by an interconnection line 337) is controllingly combined with a time control 45 which is integral with an adjustment controller 450.

During operation of a textile machine, for whatever reasons, short or long term interruptions of current can occur, in which case, the necessary voltage for the orderly operation of the machine is no longer available. In a case in which such a voltage failure lasts for only a very short time, a short term availability of an auxiliary voltage can be provided to avoid a shutdown of the textile machine and therewith a loss of production. This auxiliary voltage is produced for a short, specified time, for instance, by the momentum of the still running textile machine.

During this time period, the auxiliary voltage can hold those components 3, which influence the loss of the textile machine products (these products being a fiber band or a yarn), at such a level of speed and in such a speed ratio, one to the other, that there arises no great or noticeable deviation of the properties of the products from normal condition. Since the momentum of the present embodiment, which delivers the auxiliary current, is now continually losing speed, a voltage is maintained for a limited time, such as is necessary for the control and the drive of these components 3 to effect the manufacture of a product essentially unchanged in its characteristics.

In order to bridge over short power failure times, in accord with the embodiment shown in FIG. 2, the drives 32, the components 3, and the main power source 5 are permanently in connection to an auxiliary power supply source 51 by line 335. In this embodiment, the auxiliary power supply source 51 is in the form of a generator. Alternatively, this auxiliary current source 51, at the occurrence of a voltage drop-out, can be connected with the drive 32 of the component 3.

The auxiliary source 51 stands in connection with the drive 32 of the components 3 through a normally closed contact 420 of a relay 42, as well as through a normally open contact of an additional relay 43. The relays 42 and 43, which themselves control the auxiliary current source 51, are controllingly connected with the central control apparatus 4 by means of a line 421, 431. The respective second connection of the relays 42 and 43 as well as of the further apparatuses, for instance, the drives 32, are not shown for clarity of the drawing. These connections are made, however, in a conventional manner.

In order to drive the generator, that is, the source of auxiliary current, a provision has been made that a drive 6 is connected with the main current source 5 by means of a line 336. Drive 6 drives a generating apparatus 60 which incorporates a great weight. The auxiliary current source 51 is permanently driven by this apparatus 60, or at the least, a driving connection with apparatus 60 is made upon the occurrence of a voltage loss.

In the case of an open-end spinning machine, the advantageous possibility exists of designing the apparatus 60 as a shaft. This shaft conveniently is an integral part of the yarn withdrawal apparatus of all workstations 10*a*, 11*a* . . . , 20*a*, 21*a* . . . of the longitudinal side A or all workstations and 10*b*, 11*b* . . . and 20*b*, 21*b* . . . of the longitudinal side B of the machine. This shaft extends itself over the entire length of the textile machine and thus also over all of the sections $S_1 \ldots S_n$. The shaft possesses on this account a relatively high momentum, and hence also inertia, which can be put to use for the drive of the auxiliary source 51.

The drive 6 is controllingly connected by line 338, in which, as seen in FIG. 2, an individual control apparatus 61 is interposed, to the central control apparatus 4.

In accord with the design of the textile machine, it is possible that some of the control functions are controlled through the section control apparatus 41, even though, in most cases, it is advantageous to have the control run through the central control apparatus 4.

Now that the construction of the apparatus that carries out the invented process has been described above, the process itself will be explained on the basis of an open-end spinning machine with the aid of FIGS. 1 and 2.

It is assumed that the apparatus 60 in the depicted example represents the driven shaft of a yarn withdrawal apparatus, and is thus likewise designated as a component 34 in the concept of the invention. Furthermore, for the example to be described, it is taken for granted that the elements concerned include the component 3 with its drive 32 representing the feed apparatus of an open-end spinning machine.

Figure 1:
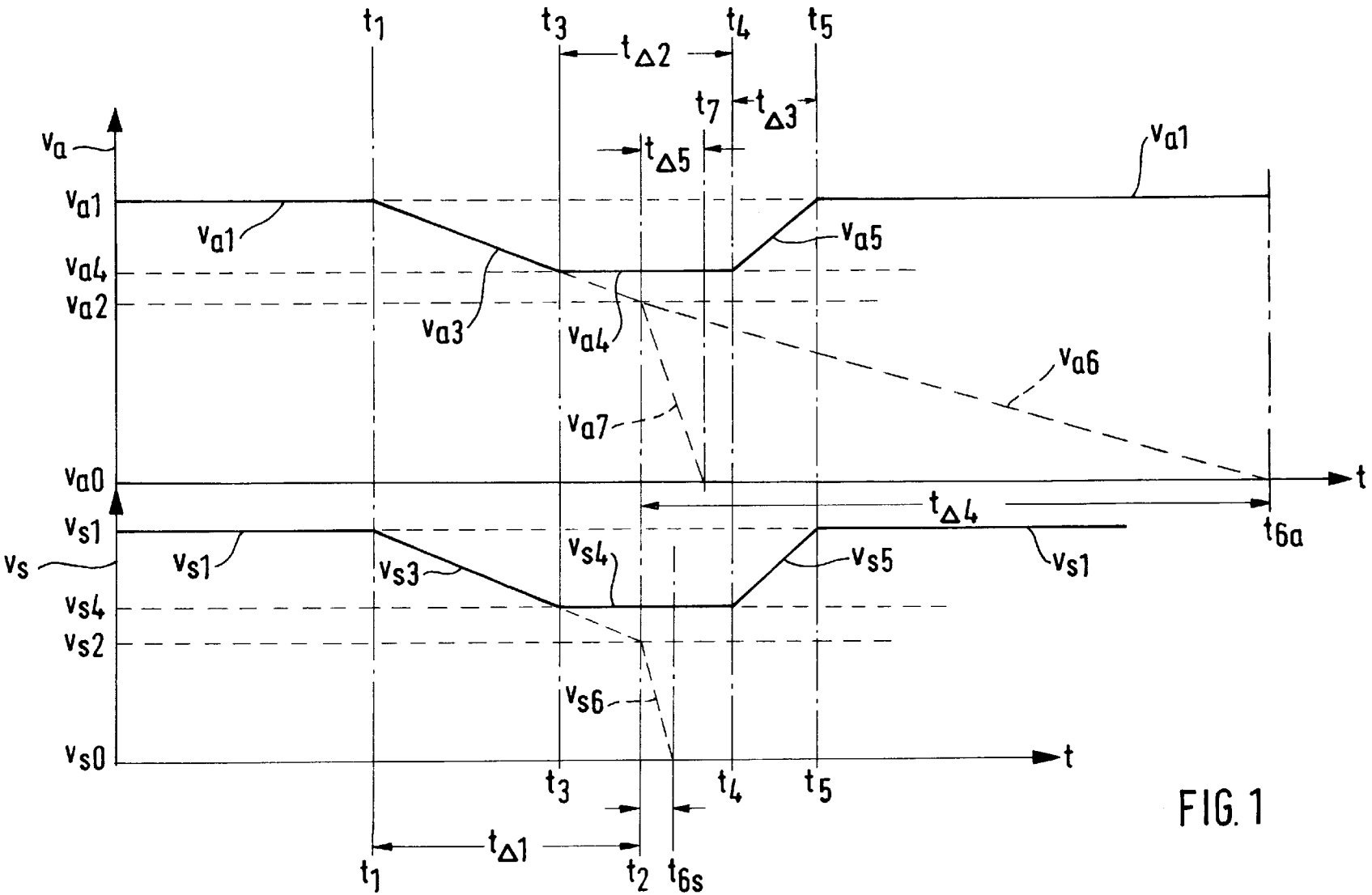
FIG. 1 shows a diagram of a continuous speed curve of a controlled component in accord with the invented process.

During normal production in an open-end spinning machine, the component 3, formed by the feed apparatus, is driven by the drive 32 with a first speed $v_{s1}$, while the yarn withdrawal apparatus (i.e., the spool drive roll), formed from the component 34 (i.e., apparatus 60), is driven at another first specified speed $v_{a1}$ (FIG. 1). These two set speeds $v_{a1}$ and $v_{s1}$ remain in an unchanging, specified speed ratio to one another.

By means of this speed ratio between first, the feed through the feed apparatus (component 3) of a fiber band, which is disintegrated into individual fibers, to the openend spinning element, and second, the withdrawal of the yarn, which has been spun from the fibers, by the yarn withdrawal apparatus (component 34), the thickness of the produced yarn arises. In order to assure a constantly uniform thickness of yarn, this speed ratio must be upheld without change during the production of this yarn.

FIG. 1 shows in a diagram as ordinate both the speed $v_s$ for the feed apparatus (component 3) and $v_a$ for the speed at the yarn withdrawal apparatus (component 34). The diagram shows as abscissa the elapsing time t. For the factors of the speed ratio in FIG. 1, $v_{s1}$ represents the set speed for the component 3 and $v_{a1}$ the set speed for the component 34, respectively.

In order to be able to drive the different components 3 and 34, which are of integral importance for production, with the required operational speeds (that is, set speeds $v_{s1}$ or $v_{a1}$) within given tolerance limits, an essentially constant operational voltage is necessary. If the supply voltage sinks below these tolerance limits, then the maintenance of the required speeds and their inter-component ratios can no longer be held, that is, the voltage relationships cannot be sustained.

In the embodiment shown in FIG. 1, the assumption is that, at time $t_1$, the current normally supplied through the main utility source 5 drops out, or at least its voltage falls below a certain specified threshold. If this is the case, then this situation is caught by the voltage monitor 50 (FIG. 2), and the central control apparatus 4 is signaled. Thereupon, with the aid of the relay 43 and its now closed contact 430, the auxiliary current source 51 kicks in, and the controlled slow-up of the machine is initiated. This is depicted in FIG. 1 by the downward sloping speed $v_{a3}$ (for the yarn withdrawal=component 34) and by $v_{s3}$ (for the feed drum=component 3). In accord with the auxiliary current source being used, this relay can remain continually in closed connection and, in the case of a voltage drop-off, is self actuating.

The slope of the curve is determined by the central control apparatus 4 and depends on the two set speeds $v_{a1}$ and $v_{s1}$ during normal production conditions on the one hand and on $v_{a2}$ and $v_{s2}$ as the lower threshold limits for sustaining the production as well as the time period $t_{\Delta 1}$ between first, the mentioned time point $t_1$ at which the voltage failed and the speed reduction set in, and second, the cutoff time $t_2$ at which the controlled reduction in speed (see the declining speeds $v_{a3}$ and $v_{s3}$) is to be ended.

For the controlled speed reduction upon the dropout of the operational voltage (at point in time $t_1$), the time controller 45 is switched on by the central control apparatus 4. In this time controller 45, the time period $t_{\Delta 1}$ and the associated cutoff point $t_2$ are stored.

During the reduction of the speeds $v_{a3}$ and $v_{s3}$, the speed-ratio remains constant in the time period after the loss of power to the components 3, which components influence the loss of yarn. That is to say, the speed ratio is only changed to such a measure, that the loss of the yarn remains, after as before, unchanged.

The speeds $v_{a3}$ and $v_{s3}$ necessary for the controlled, or in some cases, regulated running down of the components 3, are under the control of the central control apparatus 4. Contributing to this purpose, a program is input into the central control apparatus 4. This program, before production starts, is in the form of a chip or in some cases, another mobile data carrier (for instance, CD-ROM, diskette, etc.) and is so entered into the control apparatus 4. To allow this, the controller 4 possesses the mentioned designed input apparatus 46 (FIG. 2), for instance, taking on the form of a receiving slot. The program can also be transmitted over a bus system, serial communication means, or the like.

Besides this program, in a similar manner, before the start of production, the following properties are input into the central control apparatus 4:

set-speed $v_{a1}$, which, with the aid of the control apparatus 61 and the apparatus 60 (component 34) is achieved by means of drive 6 for the thread withdrawal; and the set-speed $v_{s1}$ for the feed apparatus (component 3) controlled by the individual control apparatuses 30*a*, 31*a*, 30*b*, 31*b*, . . . and achieved by means of the drive 32.

These set speeds $v_{a1}$ and $v_{s1}$ should be maintained during normal production. Furthermore, the time period $t_{\Delta 1}$ as well as the set speeds $v_{a2}$ and $v_{s2}$ are similarly preliminary inputs. The input is inserted with the aid of the adjustment device 450 of the time control apparatus 45. The input data so described should be possessed by the components 3, 34 at the run out time of the time interval $t_{\Delta 1}$, which, on the curve of FIG. 1, is marked as the time termination point $t_2$ for the machine slowdown period.

The program stored in the central control apparatus 4 computes from the stored set speeds $v_{a1}$ and $v_{a2}$ as well as the previously input time interval $t_{\Delta 1}$ the course of the declining speed $v_{a3}$ of the component 34. The apparatus 4 also computes from the stored set speed $v_{s1}$ and $v_{s2}$ and again from the time interval $t_{\Delta 1}$ the course of the declining speed $v_{s3}$ of the component 3.

Experience has shown, that for the time period $t_{\Delta 1}$, as a rule, a time of about 1 to 3 seconds is advantageous. However, this time period tal can be chosen to be proportionally greater, the higher the original speed lies, that is the set speeds $v_{a1}$ and $v_{s1}$. Conversely to this, the time period $t_{\Delta 1}$ must be reduced proportionally, the lower the original speed lies, that is the set speeds $v_{a1}$ and $v_{s1}$. Further, the elapsed time of the time period $t_{\Delta 1}$ is dependent on the value of the lower speeds $v_{a2}$ and $v_{s2}$ in comparison to what the value of set speeds $v_{a1}$ and $v_{s1}$ are. Since the lower speeds $va_2$ and $v_{s2}$, as a rule, are not free to be chosen, but are dependent upon the type of textile machine, then the time period $t_{\Delta 1}$ can be determined in most cases in dependency of the higher speeds $v_{a1}$ and $v_{s1}$.

If, before the reaching of this cutoff time $t_2$ at a time $t_3$ during the time interval $t_{\Delta 1}$, the voltage monitor 50 perceives and announces a renewed availability of a normal voltage within the previously set tolerance limits, then the central control apparatus 4 controls individual control apparatus 61 and, by means of the section controllers 41, controls the individual control apparatuses 30*a*, 31*a* . . . and possibly 30*b*, 31*b* . . . This control happens in such a way that, while maintaining the normal operatively governing speed ratios, all components 3, 34 are once again accelerated up to their operating speed (see increasing speeds $v_{a5}$ and $v_{s5}$). To allow this to happen, however, a time period $t_{\Delta 3}$ is necessary. The length of time period $t_{\Delta 3}$ is dependent upon the speed which the component 3 at the time has achieved. The sooner the normal voltage is available, that is, the nearer time $t_3$ lies to time $t_1$, the nearer the time $t_5$ can approach time $t_4$. The time $t_5$ is that time at which the components 3, 34 have again reached their respective set speeds $v_{a1}$ and $v_{s1}$. The time $t_4$ is that time at which this running up of speed begins. The nearer $t_5$ approaches $t_4$, advantageously, the shorter is the time period $t_{\Delta 3}$.

The speed changes of the individual components 3, 34 during the time periods $t_{\Delta 1}$ (between the times $t_1$ and $t_2$) and $t_{\Delta 3}$ (between the times $t_4$ and $t_5$) are carried out with the components 3, 34 essentially in proportion with one another, yet in all cases, this is neither required nor desired. If, in the case of an open-end spinning machine, for instance, during the start phase, a section of thread was produced with increased speed of rotation in order to increase the start of spinning assuredness, then, for example, the spinning element (not shown) would be greatly accelerated comparably.

If the voltage required for faultless spinning within this prespecified time period $t_{\Delta 1}$ cannot be achieved, and period $t_{\Delta 1}$ was empirically transmitted and by means of the adjusting apparatus 450 was input as a prespecification into the central control apparatus 4, that is input therein or into the integrated time control apparatus 45, then a controlled deceleration of the machine is of no further value. The reason for this is that a restoration of the necessary speed and thereby an orderly production is no longer possible. On these grounds, after reaching this predetermined time $t_2$ at the end of the time span $t_{\Delta 1}$, the auxiliary current source 51 is put out of operation. This can be carried out by:

control through the central control apparatus 4 and its associated time controller 45;

mechanical decoupling of the auxiliary current source 51 from the component 60;

electrical interruption of the line 335 by means of one or the other contacts 420 and/or 430 by appropriate control of one or the other of the two relays 42 and/or 43; and other means, such as interruption of the data exchange between the components 3, 34 and the individual control controllers thereto assigned, i.e., section control apparatuses 41 and individual control apparatus 61, respectively.

Components 3, 34 thus run in an uncontrolled manner (see speeds $v_{s6}$ and $v_{a6}$ in FIG. 1), slowing down to their respective stopping points $v_{s0}$ or $v_{a0}$ which they reach at different times $t_{6s}$ and $t_{6a}$, these times being dependent upon the respective inertia of components 3, 34.

The above explained process, along with the previously described apparatus can be altered within the framework of the present invention in a multitude of ways, in particular by the exchange of individual or multiple features with equivalents or by other combinations of features and their equivalents. Thus, it is not entirely necessary, upon the restitution of the full operating voltage, to immediately introduce the acceleration phase (see time period $t_{\Delta 3}$).

In accord with the embodiment shown in FIG. 1, this reacceleration (see speeds $v_{a5}$ and $v_{s5}$) does not occur immediately sequentially to the reduction of the speeds ($v_{a3}$ and $v_{s3}$). The reacceleration occurs only upon the interposing of a second time period $t_{\Delta 2}$, during which the components 3, 34 are driven together with an essentially constant speed $v_{a4}$ and $v_{s4}$. This time period $t_{\Delta 2}$ assures that, independent of the subsequent acceleration of the weights of the components 3, 34 after the time $t_4$, acceleration can be again carried out in a safe, desirable manner, which means under control or regulation.

Under these circumstances, components 3, 34 can be raised to the necessary set speeds $v_{a1}$ and $v_{s1}$ for normal production at which they arrive at time $t_5$. This second time period $t_{\Delta 2}$ is carried through in the same manner as the first time period $t_{\Delta 1}$ before the start of production and is regulated with the aid of the adjustment controller 450 of the time controller 45. This second time period $t_{\Delta 2}$ begins to run immediately when the voltage is restored, even before the run-out of the first time period $t_{\Delta 1}$.

As may be inferred from the speed $v_{a6}$, the time period $t_{\Delta 4}$ has endured for an extensive time from time $t_2$, within which period the component 34 has reached its lowest set speed $v_{a2}$ until stillstand $v_{a0}$ at time $t_{6a}$, because it is dependent upon the momentum of the component 34. In order to shorten the time to stillstand, $v_{a0}$ and $v_{s0}$, a provision may be made that, instead of, or in addition to, the shutdown of the auxiliary current source 51, the components 3, 34 can be quickly stopped by the activation of brakes provided for this service. In this way, the time period $t_{\Delta 4}$ is made short, during which no defined speed ratios are in effect between the driven components 3, 34, so that when stillstand ($v_{a0}$ and $v_{s0}$) is attained, once again the same ratios between the components 3, 34 come into effect. Thus, upon the occurrence of the restoration of normal voltage ratios for the startup, little time has been lost, since it is no longer necessary to wait out the inertial running of the components 3, 34 before the start of spinning occurs in the manner elsewhere described. As FIG. 1 in the example of the curve of the speed $v_{a7}$ for the yarn withdrawal (component 34) shows, the approach to stillstand $v_{a0}$, instead of first running to time $t_{6a}$ after a passage time of $t_{\Delta 4}$, advantageously achieves an essentially shortened time period $t_{\Delta 5}$ to reach time $t_7$.

After the components 3, 34 of the various work stations 10*a*, 11*a* . . . , 20*a*, 21*a* . . . and possibly, 10*b*, 11*b* . . . , 20*b*, 21*b* . . . have come to a stillstand $v_{s0}$, $v_{a0}$, the operational process can once again be taken up. In the case of an open-end spinning machine, this process is carried out by a simultaneous, common spinning startup procedure at the combined work stations 10*a*, 11*a* . . . , 20*a*, 21*a* . . . , 10*b*, 11*b* . . . , 20*b*, 21*b* . . . Alternatively, this process can occur by a sequential spinning startup beginning at a work station 10*a*, 11*a* . . . , with the others following thereafter. The startup procedure is executed in the customary and known manner and can be undertaken earlier, when the components 3, 34 more quickly reach their condition of stillstand $v_{a0}$, $v_{s0}$.

The brakes necessary for the stopping of the components 3, 34 can be designed in different and conventional ways. In the case of a component 3, the brake can arise from its drive 32, since this drive is provided with voltage through its assigned individual control apparatuses 30*a*, 31*a* . . . , 30*b*, 31*b* . . . in an appropriately regulated way.

If one of the components as described above is formed by the apparatus 60 (component 34), then this apparatus can be braked by a controlled brake 44 (FIG. 2) responding over line 440 to central control apparatus 4, which acts with the aid of the time control 45. This brake 44 can also serve to halt the apparatus 60 in a peremptory manner within the specified speed limitations provided by the central control apparatus 4. The brake 44 can do this within the time period $t_{\Delta 1}$, while the controlled slowing down of the component 3 is taking place.

The control of the decelerating and accelerating speeds $v_{a3}$, $v_{s3}$, and $v_{a5}$, $v_{s5}$ is done in the above described manner utilizing the central control apparatus 4 and sectional control 41. In accord with the design of the control apparatuses 4, 41, 30*a* 31*a*, . . . , 30*b*, 31*b* . . . , 61, it is possible to retain in memory the program for the speed reduction sequence of a component 3, 34, as well as a program for their resumption of speed. It is also a possibility to store these programs in the individual control apparatuses 30*a*, 31*a*, . . . , 30*b*, 31*b* . . . , 61, so that, in coactive operation between, first, the central control apparatus 4 and the sectional control 41 and second, the individual control devices 30*a* 31*a*, . . . , 30*b*, 31*b* . . . , 61, the curves of the speed reduction or acceleration are under proper control. The individual control apparatuses 30*a* 31*a*, . . . , 30*b*, 31*b* . . . , 61 exhibit then corresponding input arrangements (not shown).

As FIG. 2 shows, not all components must be provided separately for each work station 10*a*, 11*a* . . . , 20*a*, 21*a* . . . , 10*b*, 11*b* . . . , 20*b*, 21*b* . . . Another possibility is to provide a single, common component 34 for all work stations 10*a*, 11*a* . . . , 20*a*, 21*a* . . . , on longitudinal machine side A as well as work stations 10*b*, 11*b* . . . , 20*b*, 21*b* . . . on longitudinal machine side B. Otherwise, per work station, 10*a* . . . , several components 3 may be provided, which, in the above demonstrated manner, can be controlled.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process for control of components of a workstation within a textile machine that possesses a plurality of similar adjacent workstations, the process comprising the steps of:

running the components within the workstations at a set operational speed during normal operations of the textile machine;

providing a temporary auxiliary power source for a desired amount of time to power to the components during a voltage loss; and decelerating the components in a controlled manner during the voltage loss so that the components continue to produce a textile material for a first specified time period during which the quality of the material being produced is not adversely affected by the deceleration.

2. A process as in claim 1, further comprising accelerating the components to the operational speed in a controlled manner once full voltage is restored before cessation of the first specified time period of production during deceleration, the accelerating done in a manner so that the quality of the material being produced remains at a constant and desired level.

3. A process as in claim 2, wherein the first specified time period of production during deceleration is up to about 3 seconds.

4. A process as in claim 3, wherein the first specified time period of production during deceleration varies as a function of the set operational speed.

5. A process as in claim 2, further comprising holding constant for a second specified time period the speed at which the decelerating components are operating when full voltage is restored before accelerating the components to the operational speed in a controlled manner.

6. A process as in claim 1, wherein the deceleration of the components at the end of the first specified time period occurs in a uncontrolled manner.

7. A process as in claim 1, further comprising braking specified components at the end of the first specified time period to hasten their deceleration to a velocity of 0.

8. An apparatus for control of components of a workstation within a textile machine that possesses a plurality of similar adjacent workstations, the process comprising:

a main power source which provides said textile machine the capacity to function under normal operating conditions;

a voltage monitor operably linked to said main power source to monitor the voltage of said power source;

an auxiliary power source to power said textile machine if said voltage of said main power source drops below a threshold level;

a plurality of different control apparatuses operably linked to said components; and a central control apparatus in communication with said different control apparatuses, said voltage monitor, and said auxiliary power source, said central control apparatus engaging said auxiliary power source when said voltage monitor signals said central control apparatus that said voltage from said main power source has dropped below said threshold level, while said central control apparatus simultaneously provides instruction to said different control apparatuses which in turn cause said components to decelerate in a controlled manner so that said components continue to produce a textile material for a first specified time period during which the quality of said textile material being produced is not adversely affected by said deceleration.

9. An apparatus as in claim 8, further comprising a timing control device in communication with said central control apparatus, said timing control device setting said first specified time period during which the components will decelerate.

10. An apparatus as in claim 9, further comprising an input apparatus operably linked to said central control apparatus, said input apparatus receiving an operational speed value at which the component operates under normal conditions, a cut-off speed value at which said textile machine terminates production of said textile material being produced, and a first specified time period value representing said first time period.

11. An apparatus as in claim 8, further comprising a generating apparatus operably linked to said auxiliary power source, said generating apparatus generating a voltage which said auxiliary power source stores for use if said voltage of said main power source drops below said threshold level.

12. An apparatus as in claim 8, wherein said central control apparatus accelerates said components to said operational speed in a controlled manner once voltage increases to said threshold level before cessation of said first specified time period of production during deceleration, said acceleration is performed in a manner that the quality of said material being produced remains at a constant and desired level.

13. An apparatus as in claim 10, wherein said input apparatus further receives a second specified time period value, said second time period value representing a second time period, during which the speed is held constant, at which the decelerating components are operating when voltage increases to said threshold level before accelerating said components to said operational speed in a controlled manner.

14. An apparatus as in claim 8, further comprising a braking apparatus operably configured with said components and controllingly linked to said central control apparatus, said braking apparatus braking said component at the end of said first specified time period if said voltage of said main power source is not restored above said threshold level.

15. An apparatus as in claim 8, further comprising relays operably connected to said central control apparatus and said auxiliary power source, said relays shutting off said auxiliary power source as instructed by said central control apparatus.

16. A process as in claim 8, wherein said different control apparatuses further comprise individual control apparatuses in communication with said central control apparatus, said individual control apparatuses controlling specified components within each workstation.

17. A process as in claim 16, wherein said different control apparatuses further comprise at least one sectional control apparatus operably disposed between and in communication with said control apparatus and at least one of said individual control apparatuses to control specified components within each workstation.

18. An apparatus as in claim 8, further comprising a field bus system operably linking said components, said different control apparatuses, and said central control apparatus.

19. An apparatus as in claim 12, wherein said components signal said control apparatus that specified conditions for renewing said operational speed are fulfilled.

* * * * *